US008754734B2

(12) United States Patent
Schaffer et al.

(10) Patent No.: US 8,754,734 B2
(45) Date of Patent: Jun. 17, 2014

(54) SIMPLIFIED INDUCTIVE DEVICES AND METHODS

(75) Inventors: Christopher P. Schaffer, Fallbrook, CA (US); Aurelio J. Gutierrez, Bonita, CA (US)

(73) Assignee: Pulse Electronics, Inc., San Diego, CA (US)

( * ) Notice: Subject to any disclaimer, the term of this patent is extended or adjusted under 35 U.S.C. 154(b) by 0 days.

(21) Appl. No.: 13/023,041

(22) Filed: Feb. 8, 2011

(65) Prior Publication Data

US 2011/0193669 A1 Aug. 11, 2011

Related U.S. Application Data

(60) Provisional application No. 61/303,446, filed on Feb. 11, 2010.

(51) Int. Cl.

| | |
|---|---|
| ***H01F 27/06*** | (2006.01) |
| ***H01F 27/29*** | (2006.01) |
| ***H01F 27/30*** | (2006.01) |

(52) U.S. Cl.

USPC ..... 336/65; 336/192; 336/208

(58) Field of Classification Search

USPC ..... 336/65–68, 192, 221–222, 199, 208

See application file for complete search history.

(56) References Cited

U.S. PATENT DOCUMENTS

| | | | | |
|---|---|---|---|---|
| 2,648,031 | A * | 8/1953 | Lang et al. | 336/105 |
| 2,751,563 | A * | 6/1956 | Willyard et al. | 336/65 |
| 4,229,722 | A * | 10/1980 | Olsen | 336/192 |
| 4,356,344 | A * | 10/1982 | Carey | 174/50.56 |
| 5,212,345 | A * | 5/1993 | Gutierrez | 174/556 |
| 5,309,130 | A | 5/1994 | Lint | |
| 6,005,465 | A * | 12/1999 | Kronenberg et al. | 336/192 |
| 6,296,492 | B1 * | 10/2001 | Fujimoto et al. | 439/63 |
| 6,788,179 | B2 * | 9/2004 | Holler et al. | 336/90 |
| 7,474,187 | B1 * | 1/2009 | Huang et al. | 336/65 |
| 7,612,641 | B2 | 11/2009 | Jean et al. | |
| 2005/0194914 | A1 * | 9/2005 | Baarman et al. | 315/248 |
| 2007/0279171 | A1 * | 12/2007 | Lin | 336/65 |

FOREIGN PATENT DOCUMENTS

| | | |
|---|---|---|
| CN | 101199032 | 6/2008 |
| CN | 201075329 | 6/2008 |
| CN | 201112050 | 9/2008 |

* cited by examiner

*Primary Examiner* — Alexander Talpalatski
*Assistant Examiner* — Mangtin Lian
(74) *Attorney, Agent, or Firm* — Gazdzinski & Associates, PC

(57) ABSTRACT

A low cost, low profile, small size and high performance electronic device for use in, e.g., electronic circuits where a transformer or inductor is required. In one exemplary embodiment, the device includes a self-leaded header made from a unitary construction. The header includes a vertically oriented winding post that obviates the need for e.g. a binocular aperture type configuration. Methods for manufacturing the device are also disclosed.

20 Claims, 9 Drawing Sheets

SIMPLIFIED INDUCTIVE DEVICES AND METHODS

PRIORITY

This application claims priority to U.S. Provisional Patent Application Ser. No. 61/303,446 filed Feb. 11, 2010 of the same title, which is incorporated herein by reference in its entirety.

COPYRIGHT

A portion of the disclosure of this patent document contains material that is subject to copyright protection. The copyright owner has no objection to the facsimile reproduction by anyone of the patent document or the patent disclosure, as it appears in the Patent and Trademark Office patent files or records, but otherwise reserves all copyright rights whatsoever.

1. Field of the Invention

The present invention relates generally to circuit elements, and more particularly in one exemplary aspect to inductive devices for use in e.g., wideband RF applications, and methods of utilizing and manufacturing the same.

2. Description of Related Technology

A myriad of different configurations of inductive electronic devices are known in the prior art. Many of these inductive devices utilize so-called surface mount technology to permit more efficient automatic mass production of circuit boards with higher component densities. With this approach, certain packaged components are automatically placed at preselected locations on top of a printed circuit board, so that their leads are registered with, and lie on top of corresponding solder pads. The printed circuit board is then processed by exposure to infrared or vapor phase soldering techniques to reflow the solder and thereby establish a permanent electrical connection between the leads of the device and their corresponding conductive paths on the printed circuit board.

One such example of a prior art inductive device is illustrated in FIG. 1. The inductive device 100 of FIG. 1 is used in wideband radio frequency (RF) applications which necessitate good insertion loss performance over a wide variety of impedance ratios, and over a relatively wide frequency band (e.g. 5-200 MHz). The inductive device of FIG. 1 utilizes a discrete binocular core 110 mounted to a planar substrate 120. The planar substrate is typically constructed from an epoxy/fiberglass laminate substrate clad with a sheet of copper, or alternatively used with an underlying ceramic substrate. The windings 130 are threaded through the apertures present on the binocular core, and wrapped around the center portion of the core. The ends 132 of the windings are then secured to conductive pads 122 located on the substrate itself. Typically, these windings are secured via the use of manual soldering operations.

FIG. 2 illustrates an alternative to the inductive device of FIG. 1. Specifically, the inductive device 200 of FIG. 2 shares a similar discrete binocular core 210 and windings 230. However, the inductive device of FIG. 2 differs in that it utilizes a header 220 with integrated surface mount "gull wing" leads 222. The leads are wire wrapped with the ends 232 of the windings, and are physically and electrically secured to the gull wing leads via either an automated process (such as automated solder dipping operations), or alternatively via manual soldering operations similar to the device illustrated in FIG. 1.

While both of the prior art devices illustrated in FIGS. 1 and 2 are adequate in performing their mechanical and electrical functions, they are relatively difficult to manufacture due in part to the necessity of operators having to work with relatively small discrete components during the assembly process. For example, in order to manufacture the device illustrated in FIG. 1, a relatively fine gauge wire needs to be threaded through the binocular core apertures multiple times and secured to a relatively small electrical location using manual soldering operations performed with, for example, a soldering iron.

Accordingly, there is still a salient need for devices that are both easier and less costly to manufacture, such lower cost being enabled by, inter alia, addressing the difficulties associated with prior art inductive devices (e.g., threading of conductors, use of discrete components, hand soldering operations, etc.), while simultaneously offering improved or at least comparable electrical performance over prior art devices.

Ideally such a solution would also provide a high level of consistency and reliability of performance by limiting opportunities for errors or other imperfections during manufacture of the device.

SUMMARY OF THE INVENTION

The present invention addresses the foregoing needs by providing improved inductive apparatus and methods of manufacture and use.

In a first aspect of the invention, an inductive device is disclosed. In one embodiment, the inductive device comprises a header that includes a base portion and a winding post. Terminals protrude outwardly from the base portion and conductive windings are routed to engage the terminals and are disposed at least partly about the winding post.

In one variant, the terminals comprise self-leaded terminals.

In another variant, the header is substantially unitary, and the self-leaded terminals are integrally formed as part of the header.

In yet another variant, the winding post is generally T-shaped.

In yet another variant, the generally T-shaped winding post further comprises a substantially planar top surface adapted for pick and place operations.

In yet another variant, the base portion includes one or more wire routing apertures.

In yet another variant, the base portion includes one or more wire routing features, the wire routing features protruding outwardly from the base portion.

In yet another variant, the wire routing features are disposed symmetrically about a center line associated with the header.

In yet another variant, the base portion includes a bottom surface comprising one or more apertures that enable the header to be constructed from a two-piece mold.

In a second aspect of the invention, a header for use in an electronic device is disclosed. In one embodiment, the header comprises a substantially rectangular unitary base portion and self-leaded terminals protruding outwardly from the unitary base portion. The header also includes a substantially vertically oriented winding post.

In one variant, the terminals comprise terminals adapted for self-leading.

In another variant, the winding post extends vertically from the base portion and has a cross sectional area that is smaller at the base portion then at an opposing end of the winding post.

In yet another variant, the winding post further comprises a substantially planar top surface adapted for pick and place operations.

In yet another variant, the base portion includes one or more wire routing apertures.

In yet another variant, the base portion includes one or more wire routing features protruding outwardly from the base portion.

In yet another variant, the wire routing features are disposed symmetrically about a center line associated with the header.

In yet another variant, the base portion includes a bottom surface comprising one or more apertures that enable the header to be constructed from a two-piece mold.

In yet another variant, the header is injection-molded; e.g., in a single-step injection molding process.

In a third aspect of the invention, methods of manufacturing the aforementioned inductive devices are disclosed.

In a fourth aspect of the invention, methods of manufacturing the aforementioned headers are disclosed.

In a fifth aspect of the invention, methods of using the aforementioned self-leaded inductive devices and self-leaded headers are disclosed.

In a sixth aspect of the invention, methods of doing business utilizing the aforementioned methods and apparatus are disclosed.

In a seventh aspect of the invention, content distribution apparatus is disclosed. In one embodiment, the content distribution apparatus includes a parent substrate having electronic components mounted thereon. At least one of the electronic components comprises an inductive device having a header that includes a base portion, a winding post and terminals protruding outwardly from the base portion. One or more conductive windings are routed to engage the terminals and are disposed at least partly about the winding post.

In one variant, the inductive device comprises a wideband radio frequency (RF) transformer.

In another variant, the inductive device includes a plurality of wire routing features disposed symmetrically about a center line of the base portion to improve impedance matching and the electrical performance over a comparable device without the wire routing features.

In yet another variant, the apparatus is configured for use in a cable television network.

BRIEF DESCRIPTION OF THE DRAWINGS

The features, objectives, and advantages of the invention will become more apparent from the detailed description set forth below when taken in conjunction with the drawings, wherein.

Figure 1:
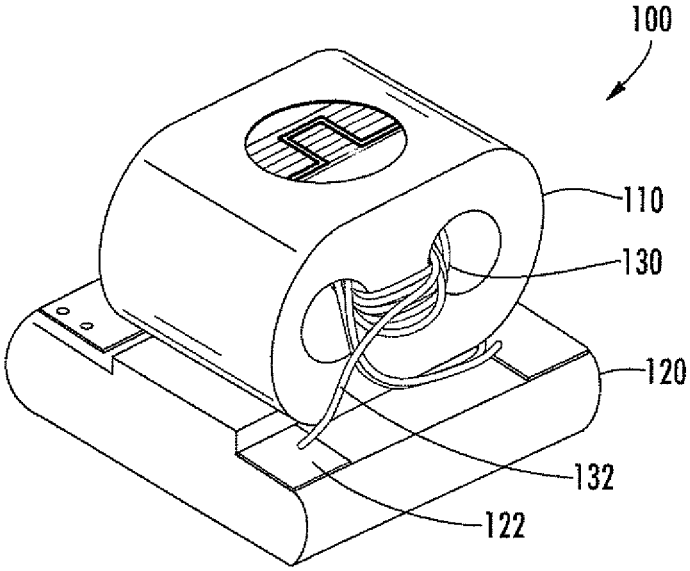
FIG. 1 (PRIOR ART)
FIG. 1 is a perspective view of a prior art wideband RF inductive device that utilizes a substrate to interface with an external circuit board.

All Figures disclosed herein are ©Copyright 2010-2011 Pulse Electronics, Inc. All rights reserved.

DETAILED DESCRIPTION OF THE PREFERRED EMBODIMENT

Reference is now made to the drawings wherein like numerals refer to like parts throughout.

As used herein, the terms "bobbin", "form" (or "former") and "winding post" are used without limitation to refer to any structure or component(s) disposed on or within or as part of an inductive device which helps form or maintain one or more windings of the device.

As used herein, the terms "electrical component" and "electronic component" are used interchangeably and refer to components adapted to provide some electrical and/or signal conditioning function, including without limitation inductive reactors ("choke coils"), transformers, filters, transistors, gapped core toroids, inductors (coupled or otherwise), capacitors, resistors, operational amplifiers, and diodes, whether discrete components or integrated circuits, whether alone or in combination.

As used herein, the term "inductive device" refers to any device using or implementing induction including, without limitation, inductors, transformers, and inductive reactors (or "choke coils").

As used herein, the term "signal conditioning" or "conditioning" shall be understood to include, but not be limited to, signal voltage transformation, filtering and noise mitigation, signal splitting, impedance control and correction, current limiting, capacitance control, and time delay.

As used herein, the terms "top", "bottom", "side", "up", "down" and the like merely connote a relative position or geometry of one component to another, and in no way connote an absolute frame of reference or any required orientation. For example, a "top" portion of a component may actually reside below a "bottom" portion when the component is mounted to another device (e.g., to the underside of a PCB).

Overview

The present invention provides, inter alia, improved low cost inductive apparatus, and methods for manufacturing and utilizing the same. As previously discussed, typical prior art inductive devices utilize a binocular core bonded to a header or other termination structure (see discussion of FIGS. 1 and 2). This termination arrangement increases the manufacturing cost (including labor and additional component costs) of the device due in part to, among other things, the small size of the components that are assembled, the use of multiple discrete components, and the requirement of having to thread conductive windings through relatively small winding apertures. Increasingly space- and performance-conscious applications demand high electrical performance and low cost. The ability to use such devices with a conventional automated "pick and place" or other production machine is also highly desirable.

The present invention is adapted to overcome the disabilities of the prior art by providing a simplified and low-cost inductive device configuration which in one embodiment eliminates the need for a separate termination header or element. Advantageously, the basic header can be configured in any number of different ways to adapt to different types of uses (e.g., inductor, transformer, etc.) and surface mount applications. The geometry of the header can also be varied as required to achieve a particular point within the performance/cost/size "design space". Exemplary embodiments of the device are also advantageously adapted for ready use by a pick-and-place, tape-reel, and other similar automated manufacturing devices, and are also preferably self-leaded so as to eliminate the necessity for insert molded conductive leads which can, in some instances, increase the overall cost of the device.

DETAILED DESCRIPTION OF EXEMPLARY EMBODIMENTS

Detailed descriptions of the various embodiments and variants of the apparatus and methods of the invention are now provided. While primarily discussed in the context of inductive devices used in wideband RF applications above 1 GHz, the various apparatus and methodologies discussed herein are not so limited. In fact, many of the apparatus and methodologies described herein are useful in the manufacture of any number of electronic or signal conditioning components that can benefit from the simplified manufacturing methodologies and apparatus described herein, which may also use different frequency ranges.

In addition, it is further appreciated that certain features discussed with respect to specific embodiments can, in many instances, be readily adapted for use in one or more other contemplated embodiments that are described herein. It can be readily recognized by one of ordinary skill, given the present disclosure, that many of the features described herein possess broader usefulness outside of the specific examples and implementations with which they are described.

Header and Inductive Device

Figure 3:
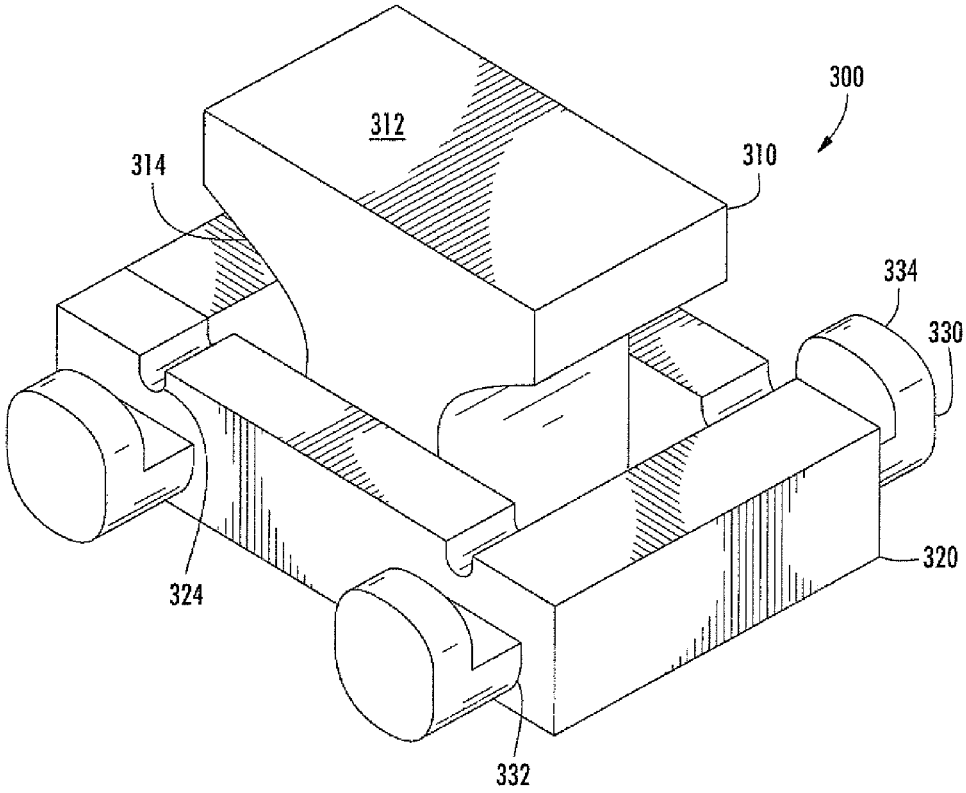
FIG. 3 is a perspective view of a self-leaded header in accordance with one embodiment of the present invention.

Referring now to FIG. 3, an exemplary embodiment for an improved header 300 for use as an inductive device is illustrated. The header of FIG. 3 offers four (4) main advantages over prior art devices, these advantages allowing the resulting inductive device to be easier to manufacture, less costly to produce, and which help ensure repeatability of construction during the manufacturing process. These advantages include: (1) a unitary construction; (2) the elimination of the need to thread magnet or other wire through apertures; (3) the ability to be assembled into a final product using automated processes; and (4) elimination or at least reduction in size (depending on the desired configuration) of a magnetically permeable (e.g., ferrite) core.

The header of FIG. 3 is produced, in an exemplary embodiment, from an injection molded polymer in a unitary configuration. In an exemplary implementation, the polymer is a material that is resistant to high temperatures (such as those experienced during solder reflow operations) such as a well known liquid crystal polymer (LCP), a phenolic resin, or the like. Specifically, the use of high temperature polymers enables, inter alia, the use of the header in both: (1) solder dipping operations (i.e., direct exposure of the header to molten solder without damage); and (2) solder reflow processes, thereby enabling the header to be surface-mounted to a substrate. As an alternative to the use of polymers, the use of a ferrite based material could also be substituted and formed into a unitary construction as well. Such use of ferrite based materials are described in e.g., co-owned U.S. Pat. No. 7,612,641 issued Nov. 3, 2009 and entitled "Simplified surface-mount devices and methods", the contents of which are incorporated herein by reference in their entirety.

Figure 3A:
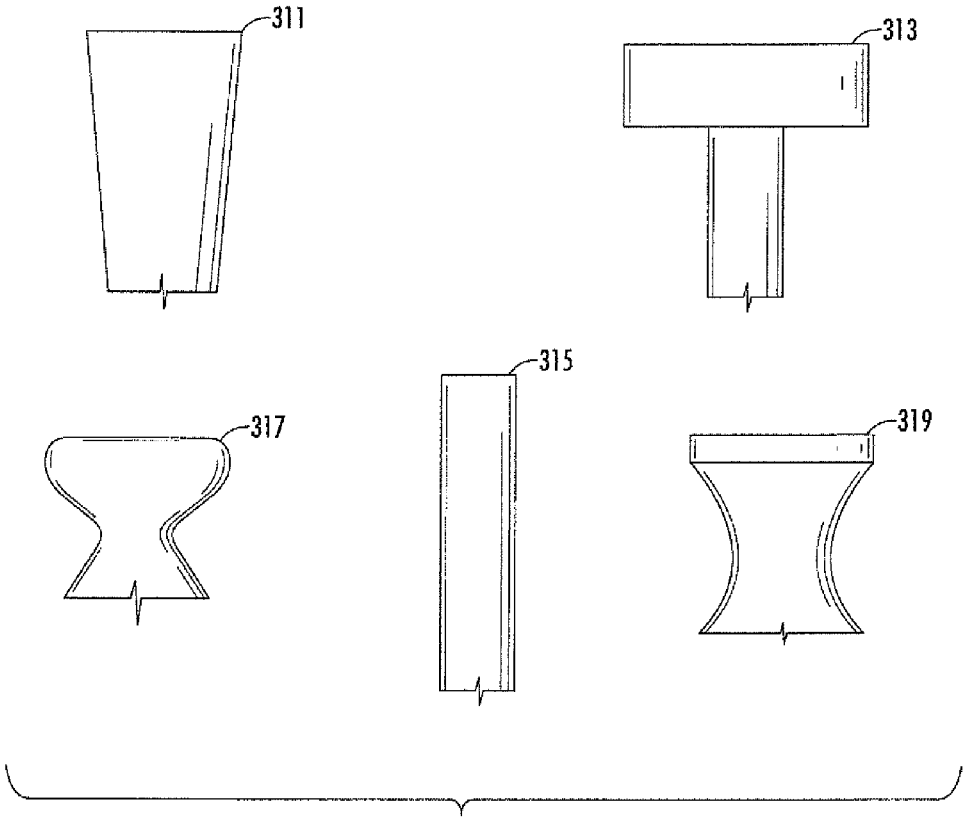
FIG. 3A is a front elevation view of alternative winding post implementations for use with the self-leaded header of FIG. 3.

The unitary header construction of the embodiment of FIG. 3 consists primarily of a body portion 320 with multiple ones of self-leaded legs 330 protruding outwardly therefrom. In addition, the body portion includes a winding element 310 extending vertically from the base. This winding element is shown in FIG. 3 as being generally "T-shaped", although it is recognized that other shapes (such as e.g., those illustrated in FIG. 3A) could readily be substituted. As illustrated in FIG. 3A, alternative winding posts can include for example, an inversely tapered post 311, a squared off T-shaped post 313 roughly similar to that illustrated in FIG. 3, as well as a straight post 315. In addition, bottle shaped posts 317, 319 (i.e. where the center portion of the post is smaller in cross section then either end) could also be substituted. These bottle shaped posts are useful in "bunching" the windings as discussed subsequently herein. Other possible configurations might include e.g., a modulated (e.g., sinusoidal) or notched post (not shown).

The post(s) of the header 300 are preferably circular, elliptical, or semi-circular in cross section so as to minimize potential damage to the windings that are disposed thereon; however it is also envisioned that polygonal cross-sections (such as squares, rectangles, pentagons, hexagons, octagons, etc.) could also be incorporated into the illustrated winding post shapes.

Figure 2:
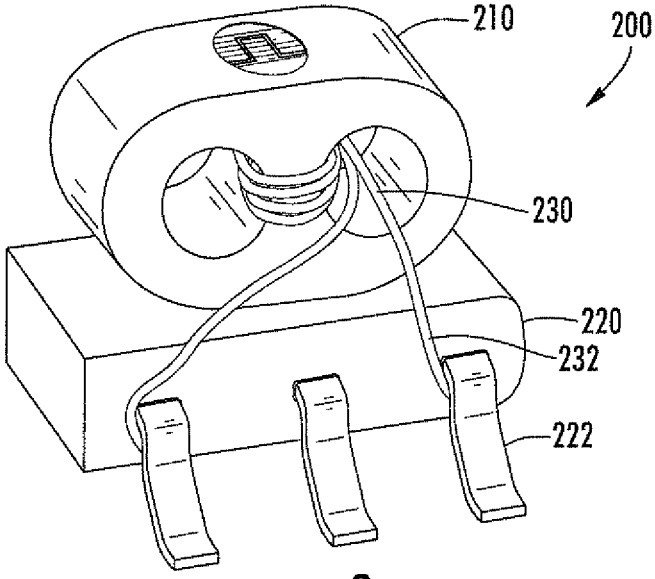
FIG. 2 (PRIOR ART)
FIG. 2 is a perspective view of a prior art wideband RF inductive device that utilizes a header to interface with an external circuit board.

As the components of the embodiment of FIG. 3 are integrally molded together into a unitary body, there is advantageously no need to separately procure and assemble multiple discrete components (as was necessary with the prior art components illustrated in FIGS. 1 and 2). The header essentially comes pre-packaged, so that it only needs to be wound (as discussed more fully subsequently herein), thereby obviating a number of processing steps that were required under the prior art. For example, contrast the header of FIG. 3 with the prior art, which necessitated a separate assembly process for the binocular core in order to attach this core to the underlying substrate (FIG. 1) or header (FIG. 2). One common prior art method was to secure the core via a gluing process which necessitated, for example, the application of a thermally cured epoxy. The use of a thermally cured epoxy possesses several disadvantages over the use of a unitary construction. Specifically, by requiring an operator to separately glue a core onto a substrate or a header, the device is susceptible to variations in construction, which can lead to inconsistent electrical performance or yield issues—resulting in the need to either scrap or rework parts. Furthermore, this prior art assembly approach requires at least some intervention by an operator, which adds labor costs to the part thereby increasing part cost. In addition, the epoxy can unintentionally spread from its intended location, which can potentially contaminate sensitive portions such as the leads of FIG. 2 or the conductive pads of FIG. 1. Accordingly, by (i) avoiding these additional processing steps and obviating one or more components/materials, and (ii) producing the header of the device in a single processing step, the overall cost of the header (and the subsequently formed inductive device) is minimized.

The body 320 of the header 300 gives support for the underlying structure that provides the functionality for the device. Protruding from the body are a number of self-leaded terminals 330 that are, in the illustrated example, produced from the same material and manufacturing process that created the underling body 9 although this is not a strict requirement of practicing the invention; other types of terminals may be used as well, examples of which are described subsequently herein). The use of self-leaded terminals is described in, for example, co-owned U.S. Pat. No. 5,212,345 issued May 18, 1993 and entitled "Self leaded surface mounted coplanar header", the contents of which are incorporated herein by reference in their entirety. The self-leaded terminals are generally rounded or elliptical in shape in order to accommodate the windings of the wire without damaging the wire when it is wrapped around the terminals. At the outer end of the terminals is an optional flange 334, which helps maintain the windings onto the spool portion 332 of the terminals that receives the windings.

At the interface between the terminals and the internal cavity 322 of the body is also an optional routing aperture 324 or guide for use with the windings wrapped around the winding element 310.

It is appreciated that while four (4) terminals are illustrated in the embodiment of FIG. 3, more or less terminals could be readily added for the purpose of providing additional electrical connections, or at the very least, the possibility of utilizing more or less electrical connections.

As an alternative to the use of self-leaded terminals, the use of insert molded or post inserted metallic leads (e.g., "gull wing" leads such as that illustrated in FIG. 2, or even through-hole terminals) could also be substituted in place of the self-leaded terminals 330 illustrated in FIG. 3.

The winding element 310, as was previously discussed, consists of a vertical post (in the illustrated embodiment, the vertical post is generally "T-shaped"). This vertical post receives a given number of turns of conductive wire (e.g. insulated magnet wire), which may be as few as a fraction of a single turn, or as many as multiple complete turns consistent with the dimensions of the vertical post. The conductive wire ends are then secured to respective self-leaded terminals. In addition to acting as a winding post for the conductive windings, the winding element 310 illustrated also obviates the need to use a binocular core as was commonly used in the past. As the conductive winding no longer needs to be threaded through individual apertures on the binocular core, the winding operation for device is substantially simplified over prior art techniques, resulting in a part that can be wound much quicker thereby reducing (and in some cases eliminating) the amount of time an operator needs to spend to manufacture the device. It is also contemplated that certain configurations of the device can be wound using substantially automated approaches (i.e., without manual intervention). This results in a much more cost-effective part to produce.

In the illustrated embodiment, the winding element extends vertically along a central longitudinal (vertical) axis. The windings are then wound about the winding element such that the longitudinal axis is substantially concentric with the windings disposed thereon.

One noted advantage of using a substantially T-shaped winding post 310 is the ability to expand the area of the top surface 312. This is particularly useful when the device is placed in commonly used packaging such as carrier tapes, thereby facilitating the device's ability to be automatically pick and placed using standard pick-and-place (e.g., vacuum-based) equipment. In addition, the T-shaped winding post 310 uses a curved transition between the base of the header and the top of the T-shaped post. This curved transition acts to "bunch" the windings towards the base of the header which helps ensure and to increase inductive and capacitive coupling between the windings, including between the primary and secondary windings in transformer applications.

Figure 4:
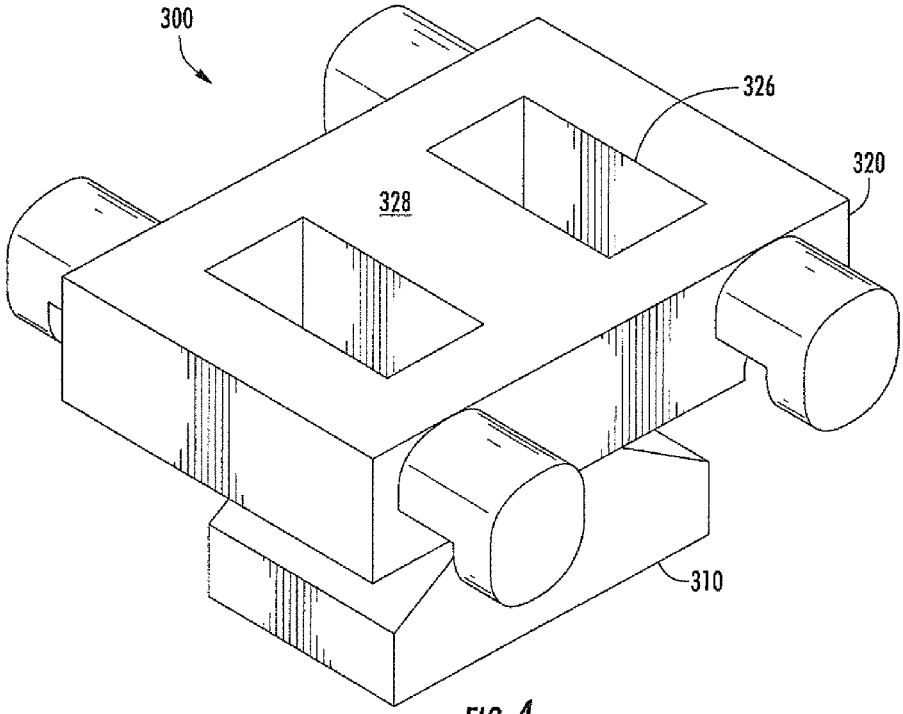
FIG. 4 is a perspective view of the underside of the self-leaded header embodiment of FIG. 3.

Referring now to FIG. 4, another cost saving advantage of the header 300 can now be seen by viewing the underside of the header. The bottom surface 328 of the header includes two (2) apertures 326 that now make it possible for the header to be injection molded using a simple two-piece mold. Without these apertures, the mold would have to be constructed with so-called "slides" that travel in a direction perpendicular to the draw direction of the main portions of the mold, in order to form the T-shaped portion of the winding post 310. The use of slides adds complexity and cost to the mold; accordingly, if the use of slides can be avoided, then the cost of the mold (and the parts produced by the mold) can be minimized.

In addition to simplifying the design of the mold, the addition of the apertures 326 also adds rigidity to the base 320 of the header as well as acts as a feature that can interface with an assembly fixture to facilitate device manufacture. Furthermore, as the wall thicknesses of the polymer in the base are now substantially uniform, the susceptibility of the base of the header to warping and twisting (e.g., due to thermal or mechanical stresses) is also reduced, which is particularly important with self-leaded designs to ensure adequate coplanarity among the terminals of the header. Such coplanarity ensures a good mechanical electrical connection to the substrate on which the header will be ultimately mounted.

Figure 5:
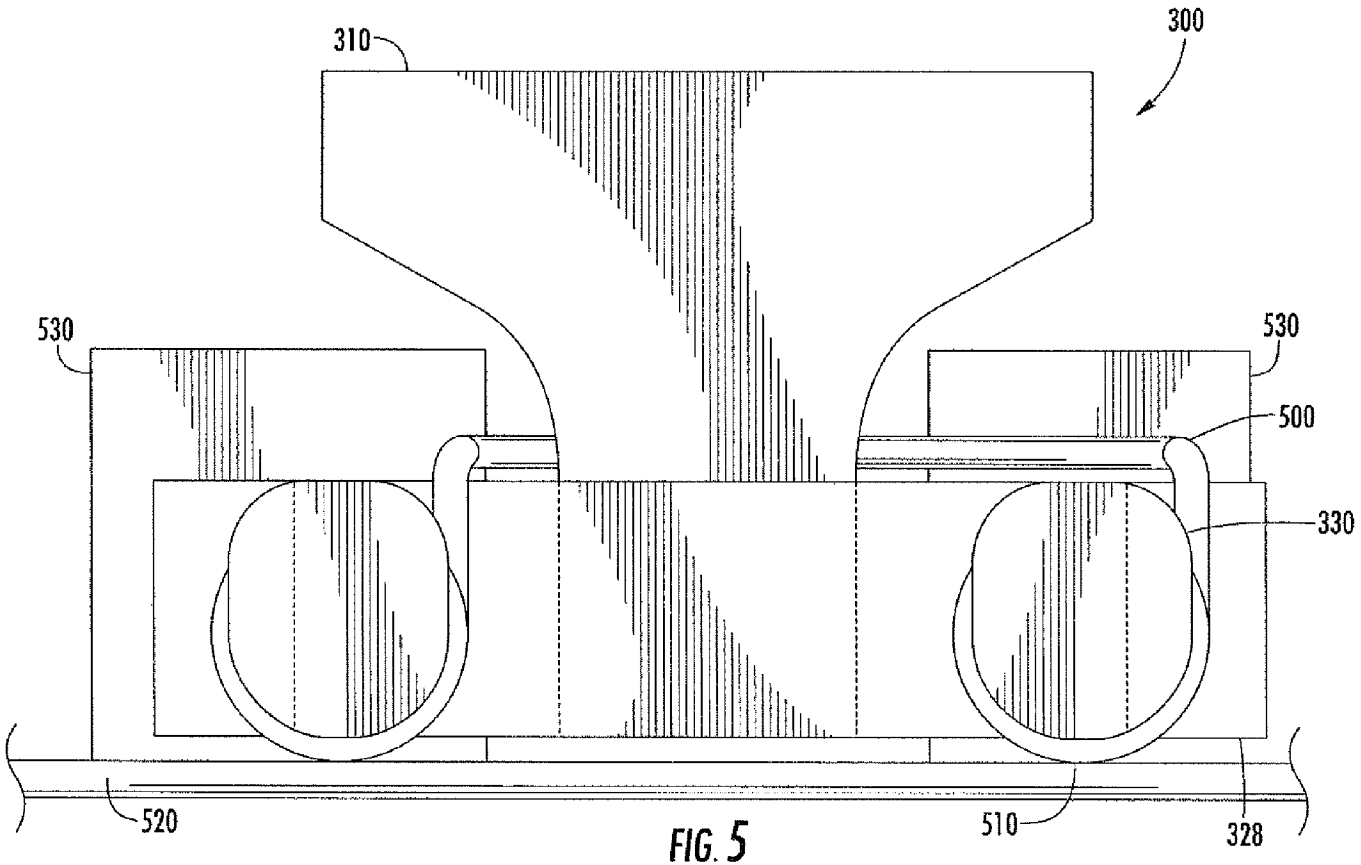
FIG. 5 is a front elevation view of a self-leaded inductive device disposed on a content distribution apparatus substrate which utilizes the header illustrated in FIGS. 3 and 4.

FIG. 5 illustrates the header 300 of FIGS. 3 and 4 with a simple one-turn winding 500 wound around the winding post 310 mounted on the parent substrate 520 of a content distribution apparatus having electronic components 530 disposed thereon. Note that the portion 510 of the windings that are wound about the terminals 330 extend below the bottom surface 328 of the header, so that they can be surface-mounted to an external substrate as previously discussed herein. In alternative embodiments to that illustrated, the terminals 330 could be raised or alternatively lowered in order to accommodate larger or smaller gauge windings, depending on the needs of the particular device implementation.

Furthermore standoffs or "feet" (not shown) may also be incorporated on the underside of the header for the purpose of, inter alia, providing a wash area underneath the mounted device for the purposes of removing corrosive chemical compounds, or for adjusting the installed height of the device on the substrate with respect to the height of the terminal pads on the substrate (which may be different in some cases); see e.g., U.S. Pat. No. 5,212,345 previously incorporated herein. Alternatively, the bottom surface of the windings may be made coplanar with the bottom surface of the header base (so that the bottoms of the windings and the base plane of the header contact a flat surface effectively simultaneously), or the bottoms of the terminals may extend below the plane of the header base (as shown in FIG. 5); see also co-owned U.S. Pat. No. 5,309,130 issued May 3, 1994 entitled "Self leaded surface mount coil lead form", incorporated herein by reference in its entirety.

Figure 6:
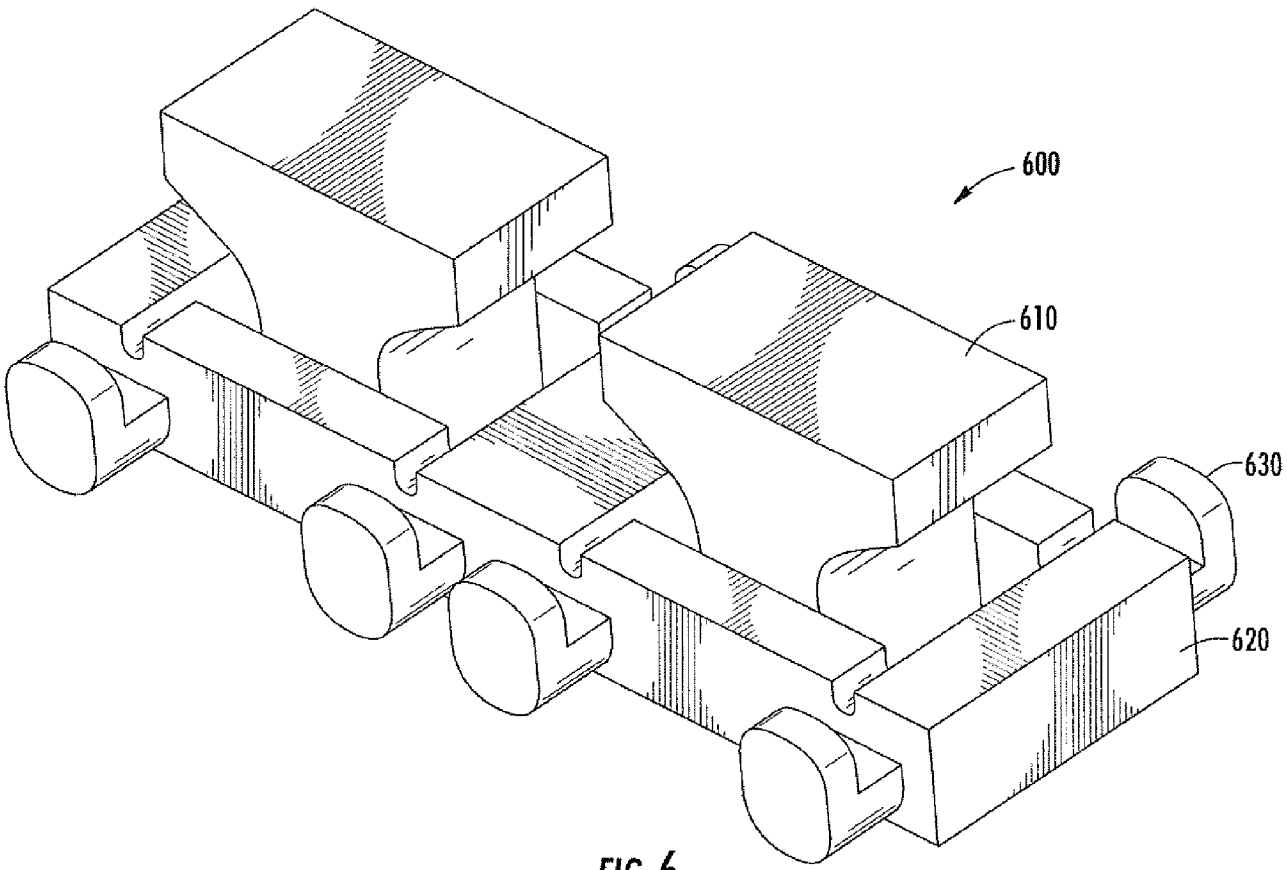
FIG. 6 is a perspective view of a multi-post self-leaded header in accordance with another embodiment of the present invention.

FIG. 6 illustrates an alternative embodiment to the header of FIG. 3 wherein an additional winding post 610 and four (4) additional terminals 630 are present on the header 600. The base 620 has also been extended in the length dimension of the device over the embodiment of FIG. 3. Such an alternative embodiment would permit, for example, two wideband RF transformers to be placed adjacent to or juxtaposed with one another. It is appreciated that the width dimension of the device may also or alternatively be varied, e.g., to accommodate other transformers, windings, or electronic components. As yet another alternative, multiple (i.e., two or more) winding posts can be placed in a side-by-side orientation.

Furthermore, a combination of the foregoing alternatives can be utilized in yet another alternative embodiment. For example, a two-by-two array of winding posts and terminals can be constructed as a unitary component which would further act to increase component density. These and other variations would be readily apparent to one of ordinary skill given the present disclosure.

Figure 7:
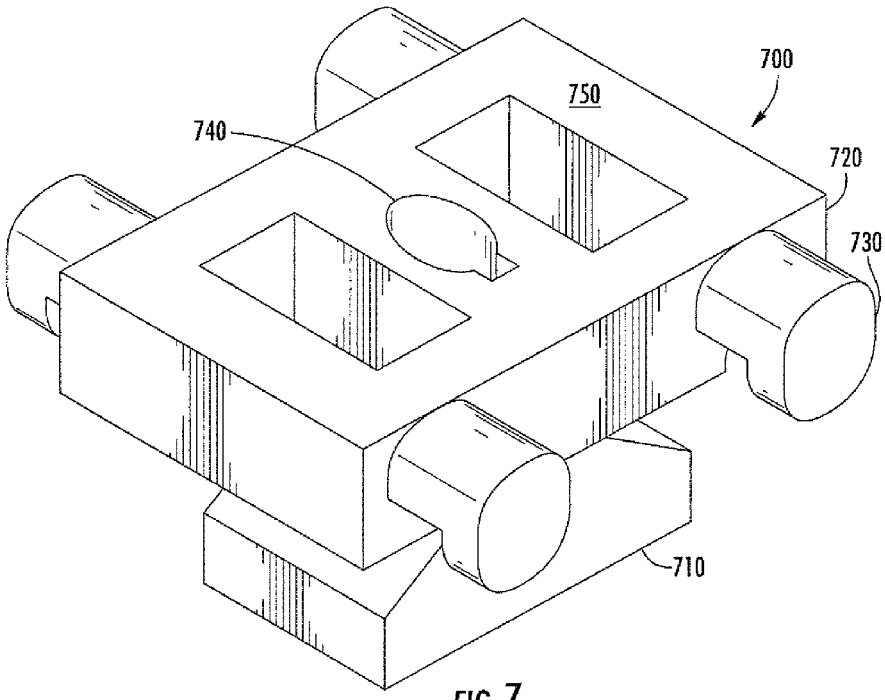
FIG. 7 is a perspective view of the underside of a self-leaded header having a keyed aperture in accordance with yet another embodiment of the present invention.

Referring now to FIG. 7, yet another embodiment of a self-leaded header 700 is shown and described in detail. Similar to the embodiment discussed in FIG. 3, the self-leaded header of FIG. 7 includes a base portion 720, a winding post 710 and four (4) self-leaded terminals 730. However, the self-leaded header of FIG. 7 also includes a keyed aperture 740 on the bottom surface 750 of the base portion 720. The keyed aperture is adapted to receive the end of a winding mandrel. This winding mandrel can then be utilized for the automated winding of the self-leaded header. Automating the winding of the header possesses several advantages over the manual winding of the self-leaded header. First, by automating the winding operation you can ensure a repeatable winding of the header which is particularly useful when a relatively large number of turns need to be placed onto the header. Furthermore, automating the winding operation can also reduce the labor costs associated with winding the header. While the keyed aperture can be used for the receipt of the end of a winding mandrel, it is also appreciated that existing apertures (such as apertures 326 in FIG. 4) could also readily be adapted for use with an automated winding mandrel.

Figure 9:
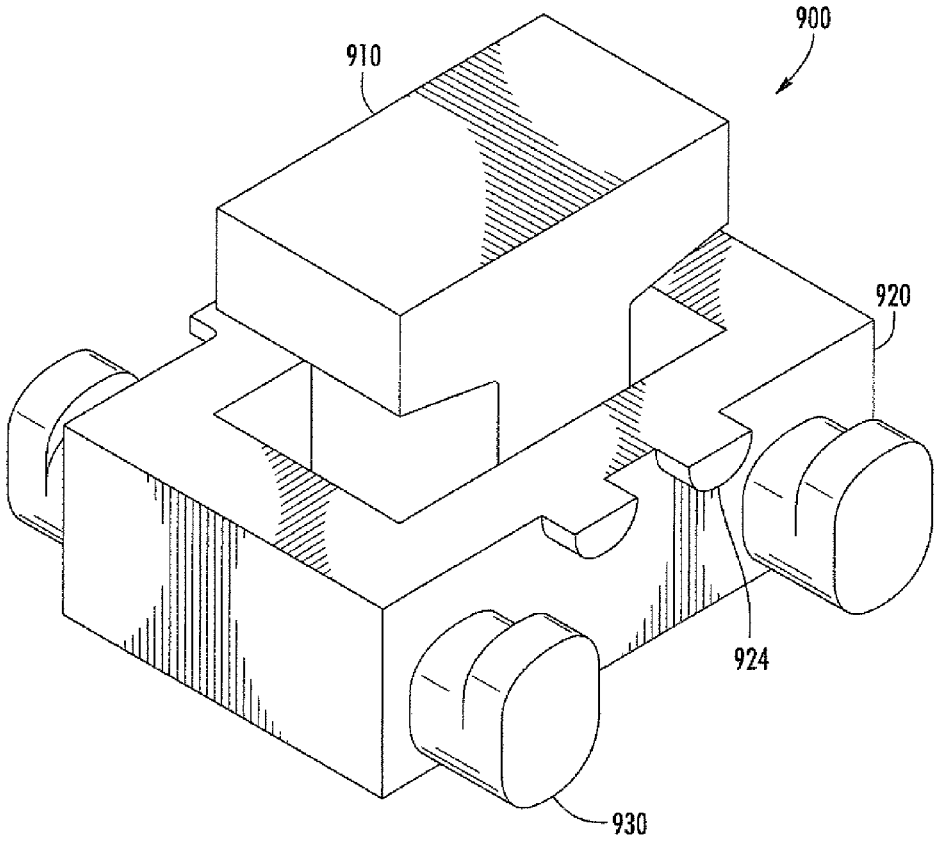
FIG. 9 is a perspective view of an alternative self-leaded header in accordance with one embodiment of the present invention.

Referring now to FIG. 9, an alternative header 900 embodiment is illustrated. In the illustrated embodiment, a plurality of wire routing features 924 are introduced onto the body portion 920 of the header. These wire routing features facilitate the routing of wires from the winding element 910 to the self-leaded terminals 930 present on the body of the header. The wire routing features will preferably include rounded edges which minimize the likelihood that they could nick, or otherwise damage the wire after it has been routed to the terminals. In one embodiment, the wire routing features are disposed symmetrically about the center line of the header. By being placed symmetrically onto the body of the header, the wire routing apertures provide a uniform wire length for the routed wire which results in improved impedance matching and electrical performance in certain winding embodiments where such a characteristic would be desirable. While the embodiment of FIG. 9 is illustrated with a T-shaped winding element and self-leaded terminals, it is appreciated that these and other features could be readily modified to include alternative features, such as those described previously herein. For example, the winding post of FIG. 9 could readily incorporate any of the alternative winding elements shown in FIG. 3A. These and other embodiments would be readily apparent to one of ordinary skill given the present disclosure.

Exemplary Inductive Device Applications

As previously discussed, the exemplary inductive devices described herein can be utilized in any number of different operational applications. In addition to wideband RF transformers, other possible electrical applications for the inductive devices described herein include, without limitation, baluns, directional couplers for use in, inter alia, basic inductors, amplifiers and signal monitor points; and RF splitters and combiners for use in, inter alia, cable media products and distribution equipment. These and other inductive device applications would be readily apparent to one of ordinary skill given the present disclosure.

Methods of Manufacture

Figure 8:
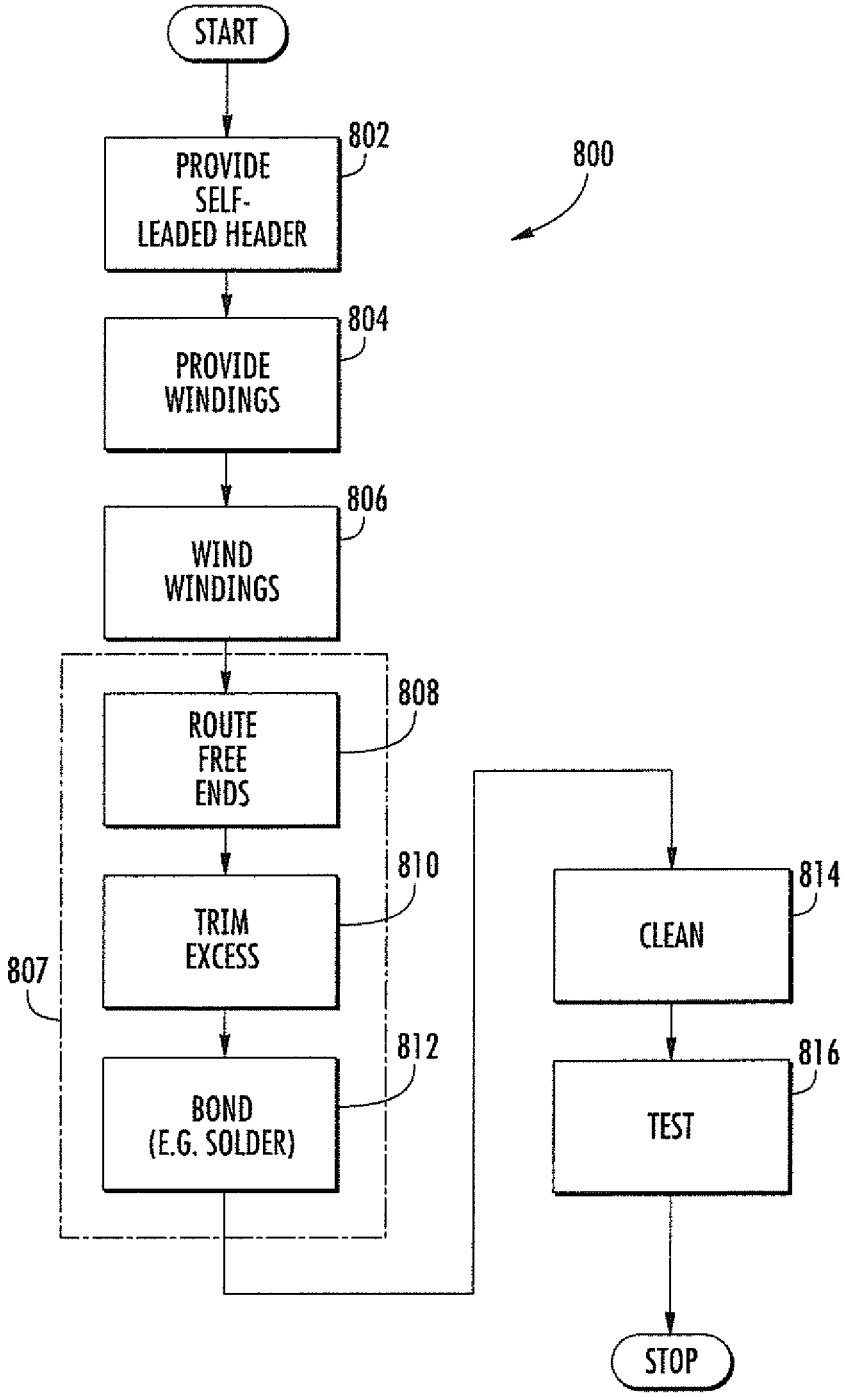
FIG. 8 is one exemplary embodiment of a process flow for manufacturing the self-leaded inductive device illustrated in FIG. 5.

Referring now to FIG. 8, an exemplary embodiment of the method 800 for manufacturing the present invention is now described in detail.

It will be recognized that while the following description is cast in terms of the device 300 of FIG. 3, the method is generally applicable to the various other configurations and embodiments of devices disclosed herein with proper adaptation, such adaptation being within the possession of those of ordinary skill in the electrical device manufacturing field when provided the present disclosure.

In a first step 802 of the method 800, one or more self-leaded headers 300 are provided. The headers may be obtained by purchasing them from an external entity, or they can be indigenously fabricated by the assembler. The header is, as was previously discussed, manufactured using a standard injection molding process of the type well understood in the polymer arts, although other constructions and processed may be used.

Next, one or more windings are provided (step 804). The windings are preferably a copper-based alloy "magnet wire" as discussed above, although other types of conductors (whether unitary strand, multi-filar, etc.) may be used.

Per step 806, the windings are next wound onto the header in the desired configuration (such as, e.g., that of FIG. 5). The header 300 may be hand-wound, or alternatively wound on a winding machine as was previously discussed with respect to FIG. 7 above.

Next, per step 807, each wound header is placed on, e.g., an assembly and solder fixture of the type known in the art, and the free ends of the windings terminated to the terminals of the wound header. This termination in the present embodiment comprises (i) routing the free ends onto the terminals 330 and pressing them or otherwise restraining them in position (step 808), (ii) trimming any excess lead wire from the terminal (step 810), and (iii) bonding them using e.g., a water soluble or resin based solder flux along with a eutectic solder (step 812). In one variant of the method 800, the header terminals 330 are immersed in solder at a temperature of approximately 395 degrees C. (+/−10 C) and dwell time of 2-4 seconds, although other approaches, types of solder, and solder profiles may be used. Alternatively, a conductive epoxy can be utilized to bond the windings onto the header and to provide an electrically conductive surface for mating to an external substrate.

Lastly, per steps 814 and 816, the headers are optionally cleaned (e.g., for 2-5 minutes in either de-ionized water or isopropyl alcohol or another solvent) using an ultrasonic cleaning machine, and then tested if desired, thereby completing the device manufacturing process 800.

It will be recognized that while certain aspects of the invention are described in terms of a specific sequence of steps of a method, these descriptions are only illustrative of the broader methods of the invention, and may be modified as required by the particular application. Certain steps may be rendered unnecessary or optional under certain circumstances. Additionally, certain steps or functionality may be added to the disclosed embodiments, or the order of performance of two or more steps permuted. All such variations are considered to be encompassed within the invention disclosed and claimed herein.

While the above detailed description has shown, described, and pointed out novel features of the invention as applied to various embodiments, it will be understood that various omissions, substitutions, and changes in the form and details of the device or process illustrated may be made by those skilled in the art without departing from the invention. The foregoing description is of the best mode presently contemplated of carrying out the invention. This description is in no way meant to be limiting, but rather should be taken as illustrative of the general principles of the invention. The scope of the invention should be determined with reference to the claims.

What is claimed is:

1. An inductive device, comprising:

a header, the header comprising:

a base portion defined by first and second ends and first and second sidewalls, the base portion having at least two molding apertures extending through the base portion;

a winding post having a bottom portion disposed between the at least two molding apertures, the winding post being integral with the first and second sidewalls, the winding post extending vertically from the bottom portion to a top portion having a larger cross sectional area than the bottom portion; and a plurality of terminals protruding outwardly from the base portion; and one or more conductive windings disposed at least partly about the winding post and routed to engage at least one of the plurality of terminals.

2. The inductive device of claim 1, wherein the plurality of terminals comprise self-leaded terminals.

3. The inductive device of claim 2, wherein the base portion, the winding post, and the plurality of terminals of the header are each part of a unitary construction.

4. The inductive device of claim 3, wherein the winding post is generally T-shaped.

5. The inductive device of claim 4, wherein the generally T-shaped winding post further comprises a substantially planar top surface configured for pick and place operations.

6. The inductive device of claim 1, wherein the first and second sidewalls of the base portion are configured to have one or more wire routing apertures formed therein.

7. The inductive device of claim 1, wherein the winding post comprises a tapered cylindrical post.

8. The inductive device of claim 1, wherein the winding post comprises a bottle-shaped post.

9. The inductive device of claim 1, wherein the winding post comprises an inversely tapered post.

10. The inductive device of claim 1, wherein at least a portion of the plurality of terminals further comprise a flange.

11. A header for use in an electronic device, the header comprising:

a unitary base portion configured to have first and second ends, first and second sidewalls, and top and bottom surfaces, the unitary base portion configured to have at least two apertures extending from the bottom surface to the top surface of the unitary base portion;

a plurality of self-leaded terminals protruding outwardly from the unitary base portion; and a vertically oriented winding post disposed between the at least two apertures and being integral with the first and second sidewalls, the vertically oriented winding post comprising a substantially tapered shape.

12. The header of claim 11, wherein the vertically oriented winding post is configured to have a cross sectional area that is smaller at a bottom portion then at a top portion.

13. The header of claim 12, wherein the top portion of the vertically oriented winding post further comprises a planar top surface configured for pick and place operations.

14. The header of claim 11, wherein the unitary base portion further comprises one or more wire routing apertures.

15. Content distribution apparatus, comprising:

a parent substrate having a plurality of electronic components mounted thereon, at least one of the plurality of electronic components comprising, an inductive device, the inductive device comprising:

a header, the header comprising:

a base portion configured to have first and second sidewalls and top and bottom surfaces, the base portion having at least two apertures extending from the bottom surface to the top surface of the base portion, the base portion also having one or more wire routing apertures disposed thereon;

a winding post having a bottom portion disposed between the at least two injection molding apertures, the bottom portion extending vertically to a top portion having a larger cross sectional area than the bottom portion; and a plurality of terminals protruding outwardly from the base portion; and one or more conductive windings routed through the one or more routing apertures, the one or more conductive windings disposed at least partly about the winding post and configured to engage at least one of the plurality of terminals.

16. The content distribution apparatus of claim 15, wherein the inductive device comprises a wideband radio frequency (RF) transformer.

17. The content distribution apparatus of claim 15, wherein the content distribution apparatus is configured for use in a cable television network.

18. The content distribution apparatus of claim 15, wherein the base portion and the winding post of the header comprise a unitary construction, and the plurality of terminals are integrally formed as part of the header.

19. The content distribution apparatus of claim 15, wherein the bottom portion of the winding post is integral with the first and second sidewalls of the base portion.

20. The content distribution apparatus of claim 15, wherein the winding post is generally T-shaped and comprises a planar top surface configured for pick and place operations.

* * * * *